US008445823B2

(12) United States Patent
Williams et al.

(10) Patent No.: US 8,445,823 B2
(45) Date of Patent: May 21, 2013

(54) GUIDED MUNITION SYSTEMS INCLUDING COMBUSTIVE DOME COVERS AND METHODS FOR EQUIPPING GUIDED MUNITIONS WITH THE SAME

(75) Inventors: Darin S. Williams, Tucson, AZ (US); Richard J. Wright, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 311 days.

(21) Appl. No.: 12/917,705

(22) Filed: Nov. 2, 2010

(65) Prior Publication Data

US 2012/0104149 A1 May 3, 2012

(51) Int. Cl.

| | |
|---|---|
| ***F41G 7/22*** | (2006.01) |
| ***H01Q 1/42*** | (2006.01) |
| *F41G 7/00* | (2006.01) |
| *H01Q 1/00* | (2006.01) |

(52) U.S. Cl.

USPC ..... 244/3.16; 244/3.1; 244/3.15; 244/3.19; 343/872

(58) Field of Classification Search

USPC ..... 244/3.1–3.19, 117 R, 119, 121, 117 A; 89/1.11, 1.1; 343/872, 873; 102/293; 342/61, 342/62

See application file for complete search history.

(56) References Cited

U.S. PATENT DOCUMENTS

| | | | | |
|---|---|---|---|---|
| 3,674,227 | A * | 7/1972 | Jacobson et al. | 244/121 |
| 3,970,006 | A * | 7/1976 | Copeland et al. | 244/117 A |
| 4,753,169 | A * | 6/1988 | Shores | 102/293 |
| 5,167,386 | A * | 12/1992 | Laquer et al. | 244/121 |
| 5,457,471 | A * | 10/1995 | Epperson, Jr. | 343/872 |
| 5,743,492 | A * | 4/1998 | Chan et al. | 244/121 |
| 8,058,595 | B2 * | 11/2011 | Koehler et al. | 244/3.1 |

OTHER PUBLICATIONS

Merems, Paul A. "Missile with Shroud that Separates in Flight," U.S. Appl. No. 12/696,123, filed Jan. 29, 2010.

Armtec Defense Products Co., combustible cartridge product description web page, 2 pages, undated; retrieved on Nov. 2, 2010 from the Internet at www.armtecdefense.com.

Williams, Darin S. et al. "Guided Munitions Including Self-Deploying Dome Covers and Methods for Equipping Guided Munitions With the Same," U.S. Appl. No. 12/917,699, filed Nov. 2, 2010.

* cited by examiner

*Primary Examiner* — Bernarr Gregory
(74) *Attorney, Agent, or Firm* — Eric A. Gifford

(57) ABSTRACT

Embodiments of a guided munition system are provided, as are embodiments of a combustive dome cover and methods for equipping a guided munition with a combustive dome cover. In one embodiment, the guided munition system includes a guided munition, which has a munition body and a seeker dome coupled thereto, and a combustive dome cover disposed over the seeker dome. The combustive dome cover is configured to uncover the seeker dome at a predetermined time of deployment and to combust when so deployed to minimize the production of debris.

26 Claims, 4 Drawing Sheets

GUIDED MUNITION SYSTEMS INCLUDING COMBUSTIVE DOME COVERS AND METHODS FOR EQUIPPING GUIDED MUNITIONS WITH THE SAME

TECHNICAL FIELD

The following disclosure relates generally to guided munitions and, more particularly, to embodiments of guided munition systems including combustive dome covers, which combust after deployment to reduce or eliminate the production of debris.

BACKGROUND

Guided missiles, rockets, and other munitions are typically equipped with a homing guidance system referred to as a "seeker." The seeker includes one or more sensors, which detect electromagnetic radiation emitted by or reflected from a designated target. Guidance electronics included within the seeker utilize the data generated by the seeker sensors, often in conjunction with data provided by other onboard systems (e.g., a global positioning system and/or an inertial navigational system), to determine the manner in which one or more flight control surfaces (e.g., wings, canards, thrust vector control vanes, etc.) should be manipulated to provide aerodynamic guidance to the munition during flight. A nose-mounted seeker dome physically protects the seeker sensors while allowing the transmission of electromagnetic radiation to the sensors during flight of the guided munition.

Multi-munition launch units, such as multi-tube launchers and rocket pods, allow the transport and independently-controlled launch of multiple (e.g., typically seven to nineteen) munitions. When a guided munition is utilized in conjunction with a multi-munition launch unit, the seeker dome of the guided munition may be exposed to rocket exhaust generated during launch of neighboring munitions. If exposure between the seeker dome and rocket exhaust occurs, harsh chemicals, soot, and other debris may deposit over the outer surface of the seeker dome (referred to herein as "dome contamination"). Dome contamination can block, attenuate, or otherwise interfere with the transmission of electromagnetic signals through the seeker dome and thereby negatively impact the guidance functionalities of the guided munition. Other possible sources of dome contamination include airborne water droplets (e.g., rain droplets); insect matter; and, in implementations wherein the guided munition is containerized, rocket exhaust produced by the guided munition's own rocket motor.

A dome cover can be positioned over the exterior of a seeker dome to physically shield the dome from rocket exhaust and other possible sources of contamination. When utilized, such dome covers must necessarily be removed or destroyed prior to seeker operation. Various deployment systems (e.g., actuators and timing electronics) have been developed to either eject a dome cover (if fabricated from a non-frangible material) or initiate fracture of a dome cover (if fabricated from a frangible material) at a desired time of deployment. Conventionally-known dome cover deployment system are, however, limited in certain respects. As one notable limitation, conventionally-known dome cover deployment systems often produce sizable, high energy debris upon dome deployment. Such debris can increase the likelihood of foreign object damage to nearby objects, including the platform or vehicle from which the guided munition is launched. As a specific example, debris created by conventionally-known dome cover deployment systems can increase the likelihood of foreign object damage to a rotary wing aircraft equipped with a rocket pod or other multi-munition launch unit from which the guided munition is launched. The production of debris during dome cover deployment may also be undesirable in instances wherein the munition is launched over a runway, which typically must be cleared of sizable debris prior to aircraft takeoff and landing.

It is thus desirable to provide embodiments of a guided munition system including a dome cover that produces little to no sizable debris upon deployment to reduce the likelihood of foreign object damage. It would also be desirable if embodiments of the dome cover were capable of self-deploying during munition flight at a predetermined munition airspeed without the aid of timing electronics or other control devices. It would also be desirable if, in certain embodiments, the dome cover could be deployed immediately prior to munition launch to enable prelaunch target verification by the munition's seeker (commonly referred to as "lock-on before launch"). Finally, it would be desirable to provide embodiments of a method for equipping a guided munition with a combustive dome cover. Other desirable features and characteristics of the present invention will become apparent from the subsequent Detailed Description and the appended Claims, taken in conjunction with the accompanying Drawings and this Background.

BRIEF SUMMARY

Embodiments of a guided munition system are provided. In one embodiment, the guided munition system includes a guided munition, which has a munition body and a seeker dome coupled thereto, and a combustive dome cover disposed over the seeker dome. The combustive dome cover is configured to uncover the seeker dome at a predetermined time of deployment and to combust when so deployed to minimize the production of debris.

Embodiments of a combustive dome cover are also provided. In one embodiment, the combustive dome cover includes an inner combustive liner, which is configured to ignite when exposed to a predetermined ignition temperature, and an outer inert layer, which is disposed over the inner combustive liner and configured to combust in conjunction with the inner combustive liner after ignition thereof.

Embodiments of a method for equipping a guided munition with a combustive dome cover are further provided. The method includes the steps of fabricating a combustive dome cover configured to combust when exposed to a predetermined ignition temperature, coupling a heating feature to the combustive dome cover, and positioning the combustive dome cover over a seeker dome included within the guided munition.

BRIEF DESCRIPTION OF THE DRAWINGS

At least one example of the present invention will hereinafter be described in conjunction with the following figures, wherein like numerals denote like elements, and.

DETAILED DESCRIPTION

The following Detailed Description is merely exemplary in nature and is not intended to limit the invention or the application and uses of the invention. Furthermore, there is no intention to be bound by any theory presented in the preceding Background or the following Detailed Description.

Figure 1:
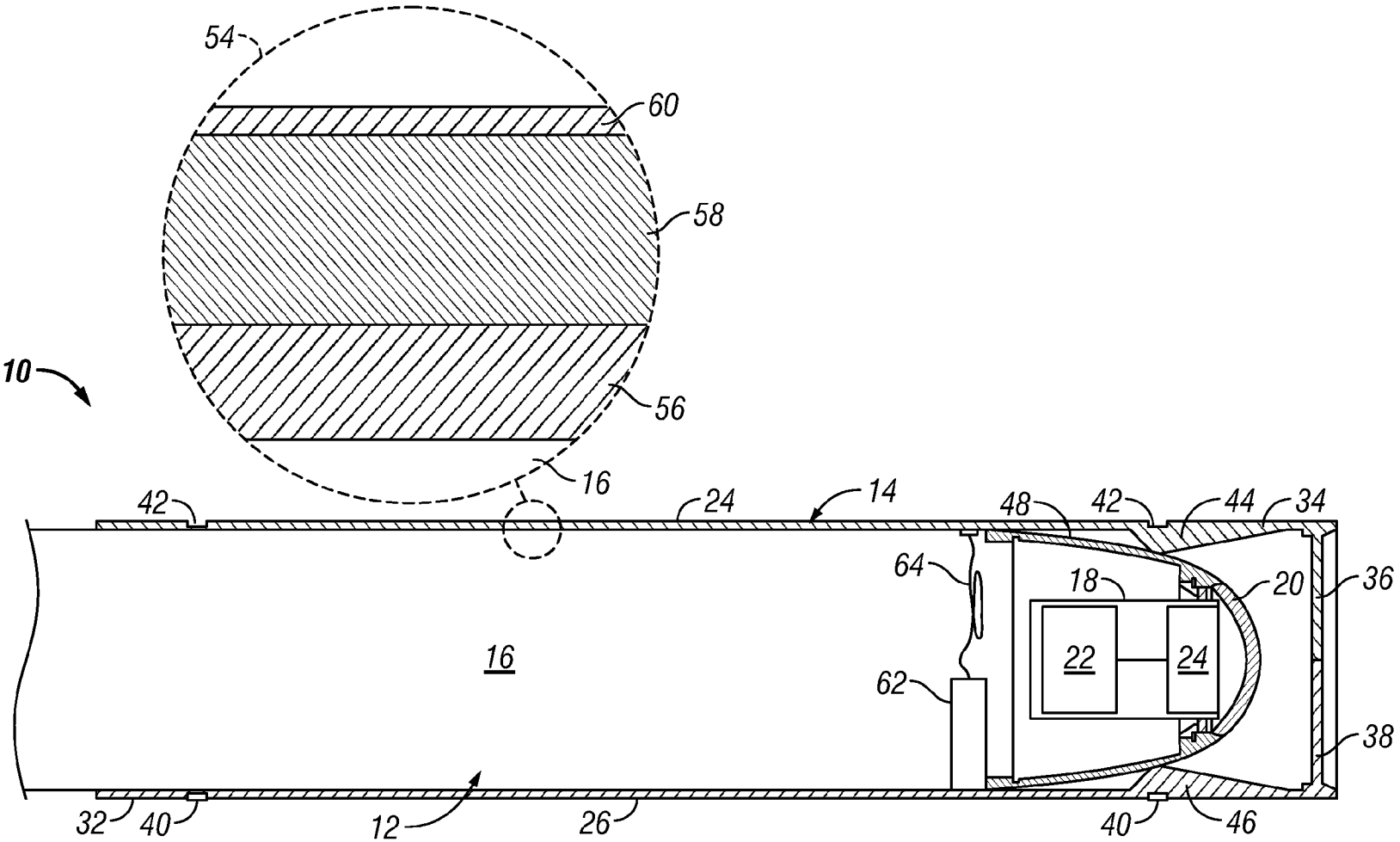
FIGS. 1 and 2 are cross-sectional and isometric views, respectively, of a guided munition system including a multi-piece combustive dome cover disposed over the forward end portion of a guided munition and illustrated in accordance with a first exemplary embodiment.

FIG. 1 is an isometric side view of a guided munition system 10 illustrated in accordance with a first exemplary embodiment. Guided munition system 10 includes a guided munition 12 (partially shown) and a combustive dome cover 14 disposed over a forward end portion of guided munition 12. Guided munition 12, in turn, includes a munition body 16; a homing guidance system or seeker 18 housed within a forward section of munition body 16 (shown in cutaway in FIG. 1); and a seeker dome 20 mounted to the forward end of munition body 16. As a point of emphasis, guided munition 12 may assume the form of any guided missile, bomb, rocket, or other munition having guidance capabilities and including a seeker dome (or like structural element or window) through which electromagnetic signals are received. Although by no means restricted to such a usage, embodiments of guided munition system 10 are particularly well-suited for usage within multi-munition launch units (e.g., multi-tube launchers and rocket pods) deployed onboard vehicles and, specifically, onboard rotary wing aircraft.

As generically illustrated in FIG. 1, seeker 18 includes control electronics 22 (e.g., e.g., a control card stack) and one or more electromagnetic ("EM") radiation sensors 24, which are operably coupled to control electronics 22. EM radiation sensors 24 are positioned adjacent to and may reside within seeker dome 20; e.g., in one common implementation, sensors 24 are carried by a gimbal assembly (not shown) partially disposed within dome 20. Although not shown in FIG. 1 for clarity, seeker 18 will include a number of other conventionally-known components suitable for providing the desired homing functionalities. Such components may include, but are not limited to, antennae, internal navigational systems (e.g., global positioning systems and/or inertial navigational systems), power supplies (e.g., battery packs), and the like. Seeker 18 may also include a data link (e.g., a networked radio antenna) to enable the transmission of in-flight targeting updates and imaging data. Guided munition 12 may likewise include various components that are conventionally-known in the aerospace and munition industries and not described herein. Such components may include, but are not limited to, a plurality of manipulable flight control surfaces (e.g., canards, wings, and/or thrust vector control vanes), warheads, fuses, batteries, additional electronics (e.g., a mission computer), and propulsion devices (e.g., a solid propellant rocket motor).

Seeker dome 20 is transmissive to one or more bandwidths of electromagnetic radiation emitted by or reflected from a designated target and detectable by EM radiation sensors 24. Seeker dome 20 will typically be transmissive to one or more of the visible, near infrared, midwave infrared, long wave infrared, and/or millimeter-wave radio frequency bandwidths. Seeker dome 20 can be formed from any material, currently known or later developed, that allows the transmission of EM signals through dome 20 within the desired sensor bandwidth(s) and that possesses sufficient structural strength to remain intact during munition handling, launch, and flight. By way of non-limiting example, seeker dome 20 may be formed from diamond, sapphire, zinc sulfide (ZnS), yttrium oxide ($Y_2O_3$) aluminum oxynitride (AlON), Spinel ($MgAl_2O_4$), magnesium fluoride ($MgF_2$), composite optical ceramics, or similar materials. Although by no means limited to a particular geometry, seeker dome 20 will typically be either hemispherical or ogival in shape.

EM radiation sensors 24 are configured to receive electromagnetic radiation through seeker dome 20 and emitted from or reflected from a designated target to support passive guidance, semi-active guidance, or active guidance functionalities of guided munition 12. EM radiation sensors 24 may comprise any number of electromagnetic radiation detection devices suitable for performing this purpose by detecting radiation within any given frequency band of the electromagnetic spectrum; e.g., within ultraviolet, visible, near-infrared, mid-infrared, far-infrared, microwave, and/or radio wave frequencies. As a non-exhaustive list of examples, EM radiation sensors 24 may include one or more visible spectrum, semi-active laser, infrared, and/or millimeter wave detection devices. For example, in implementations wherein guided munition 12 assumes the form of a laser guided rocket, EM radiation sensors 24 may include at least one semi-active laser sensor. In embodiments wherein seeker 18 assumes the form of a dual- or tri-mode seeker, EM radiation sensors 24 may also include a millimeter wave radar sensor and/or an uncooled imaging infrared sensor.

Figure 2:
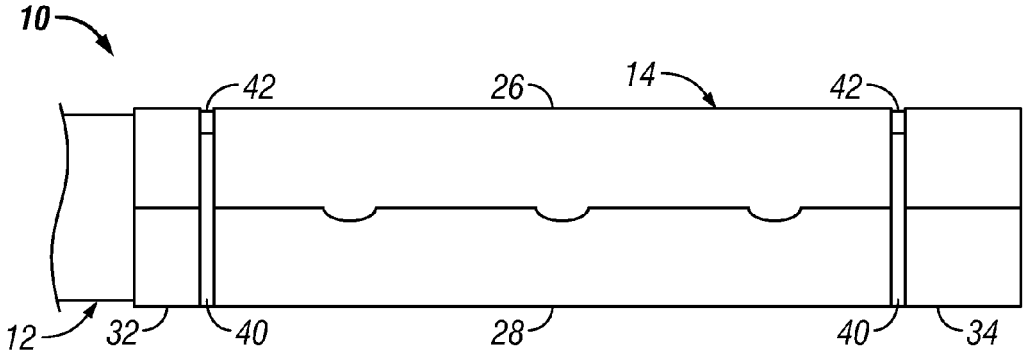

FIG. 2 is an isometric view of combustive dome cover 14 and the forward end portion of guided munition 12. As can be seen in FIGS. 1 and 2, combustive dome cover 14 is disposed over the forward end of guided munition 12 and, therefore, surrounds and encloses seeker dome 20. In so doing, combustive dome cover 14 physically shields or isolates seeker dome 20 from potential sources of contamination, such as rocket exhaust generated by launch of neighboring munitions, prior to the launch of and during an initial flight phase of guided munition 12. In the illustrated example, combustive dome cover 14 overlays a substantial forward, and possibly intermediate, portion of munition body 16 in addition to seeker dome 20. However, in further embodiments, dome cover 14 may cover a greater or lesser portion of munition body 16, or may not overlay any portion of munition body 16. Although shown in FIGS. 1 and 2 and described below as having a specific geometric form (i.e., that of an elongated blind tube), the geometry of combustive dome cover 14 will inevitably vary amongst different embodiments; e.g., in certain embodiments, the body of dome cover 14 may generally be characterized by a dome- or cone-shaped geometry, such as that described below in conjunction with FIG. 7. The dimensions of combustive dome cover 14 may be scaled, as appropriate, to accommodate munitions of varying sizes.

Combustive dome cover 14 may be fabricated as a unitary piece or monolithic body. Alternatively, combustive dome cover 14 may be assembled from two or more individual cover pieces. In embodiments wherein combustive dome cover 14 is comprised of multiple pieces, it is preferred that the dome cover pieces are detachably joined so as to promote the subsequent separation or decoupling of the dome cover pieces at a desired time of deployment, typically either during an early phase of munition flight or immediately prior to munition launch. With respect to the exemplary embodiment illustrated in FIGS. 1 and 2, specifically, combustive dome cover 14 includes two principal dome cover pieces: i.e., a first longitudinal cover piece 24, and a second longitudinal cover piece 26. Cover pieces 24 and 26 each have an elongated arcuate geometry such that, when dome cover 14 is assembled, cover pieces 24 and 26 cooperate to form an elongated, tubular shroud 24, 26. Aft end 32 of tubular shroud 24, 26 is open and receives munition body 16 therethrough. Conversely, forward end 34 of tubular shroud 24, 26 is closed-off or blocked by a forward wall 36 having an aerodynamically-blunt outer face 38. In the illustrated example, forward wall 36 is formed by first and second halves, which are coupled to (e.g., integrally formed with) cover pieces 24 and 26, respectively, and which extend radially inward therefrom to form forward wall 36 when dome cover 14 is assembled. In further embodiments, forward wall 36 may comprise a unitary structure, which is integrally formed with either cover piece 24 or cover piece 26. As a still further alternative, forward wall 36 may be fabricated as a single independent piece (e.g., a disc or plate) that is retained between cover pieces 24 and 26 when dome cover 14 is assembled; e.g., forward wall 36 may be captured within an annular groove provided around an inner circumferential surface of shroud 24, 26. If desired, cover pieces 24 and 26 may be sealed or provided with an edge labyrinth in certain embodiments to prevent or minimize blow-through of cover 14.

As noted above, cover pieces 24 and 26 are preferably joined together so as to enable the separation of tubular shroud 24, 26 during flight of guided munition 12 or immediately prior to the launch thereof. In one implementation, cover pieces 24 and 26 are joined together by one or more retainer bands 40, which extend at least partially around an outer circumferential surface of tubular shroud 24, 26 to maintain cover pieces 24 and 26 in an assembled stated. If desired, and as shown most clearly in FIG. 2, each retainer band 40 may be received within an outer circumferential groove 42 provided around shroud 24, 26. Retainer bands 40 are configured to release cover pieces 24 and 26 when a sufficient force is exerted on cover piece 24 and/or cover piece 26 in a radially outward direction (referred to herein as a "radial separation force"). In embodiments wherein bands 40 do not form a complete loop or ring (e.g., in embodiments wherein bands 40 are C-shaped), retainer bands 40 may deflect to release cover pieces 24 and 26 from their assembled state. Alternatively, retainer bands 40 may be designed to rupture, facture, or otherwise break when subjected to a sufficient radial separation force. For example, retainer bands 40 may be formed to have one or more structurally weakened areas created by, for example, perforation, scoring, or regions of reduced thickness. Retainer bands 40, and other structural elements configured to brake or yield and thereby permit the separation of a multi-piece dome cover, may be generically referred to herein as "releasable retainer members."

The radial separation force initiating the release of retainer bands 40 can be generated by a mechanical or pyrotechnic means, such as by one or more separation charges disposed between the cover pieces. However, in a preferred embodiment, the radial separation force initiating release of retainer bands 40 is derived from aerodynamic forces acting on combustive dome cover 14 during munition flight. For example, as shown in FIG. 1, cover pieces 24 and 26 may each include inner radial projections 44 and 46, respectively, which project from an interior surface of their respective cover pieces to contact an outer radially-tapered surface 48 of guided munition 12. As utilized herein, the term "radially-tapered surface" denotes a surface of guided munition 12 that is inclined with respect the munition's longitudinal axis and that increases in width or diameter when moving along the munition's longitudinal axis in a fore-aft direction. In most embodiments, radially-tapered surface 48 will be the outer surface of the munition nose, which is typically conical or ogival in shape. As illustrated in FIG. 1, inner radial projections 44 and 46 are conveniently formed as wedge-shaped protrusions, which may be integrally formed with cover pieces 24 and 26, respectively, or discretely-fabricated and fixedly coupled (e.g., welded) thereto. Inner radial projections 44 and 46 may or may not extend around the entire inner circumference of tubular shroud 24, 26.

Figure 3:
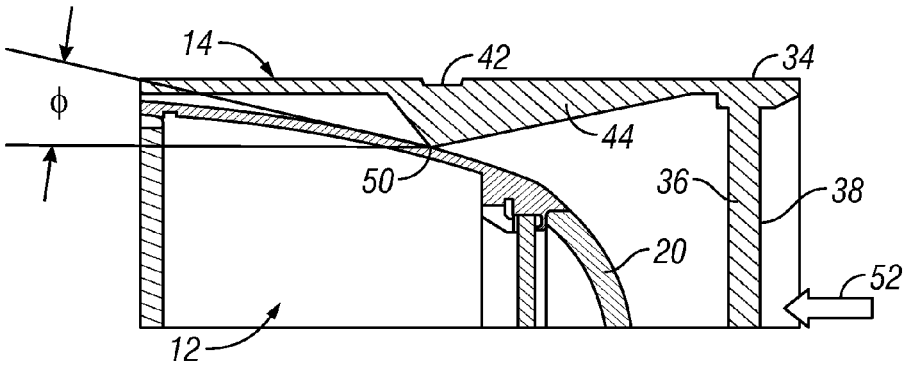
FIG. 3 is a detailed cross-sectional view of the combustive dome cover shown in FIGS. 1 and 2 illustrating the mechanical interaction between an inner radial projection of the dome cover and an outer nose surface of the guided munition.

FIG. 3 is a isometric view illustrating the mechanical interaction between inner radial projection 44 and outer radially-tapered surface 48 in greater detail. Projection 44 extends radially inward from cover piece 24 to contact outer radially-tapered surface 48 at a contact point 50 and form a wedge interface (identified as theta, θ). During munition flight, airflow (represented in FIG. 3 by arrow 52) impinges on blunt face 38 of leading wall 36 and exerts a drag force on combustive dome cover 14 in opposition to the forward thrust of guided munition 12. When the disparity between these antagonistic forces surpasses a threshold value, combustive dome cover 14 slides in an aftward direction relative to guided munition 12; and projection 44 travels along (more informally, "rides") the outer radially-tapered surface 48, which gradually increases in width in the aft direction due to the conical shape of the nose section of munition 12. At the same time, projection 46 (shown in FIG. 1) likewise moves along an outer radially-tapered surface of the nose section of munition 12 substantially opposite outer radially-tapered surface 48. Cover pieces 24 and 26 gradually separate or spread-apart as combustive dome cover 14 slides along guided munition 12 in this manner, and the outward radial force exerted on cover pieces 24 and 26 by radial projections 44 and 26 gradually increases. When the radial separation force surpasses a threshold value, bands 40 yield (e.g., deflect or break), and cover pieces 24 and 26 separate, fall away from guided munition 12, and expose underlying the seeker dome 20.

As addressed in the foregoing section entitled "Background," it is desirable to minimize or eliminate the production of sizable, high-energy debris upon dome cover deployment to decrease the likelihood of foreign object damage to nearby objects, as well to the vehicle or platform from which the guided munition is launched. In this regard, combustive dome cover 14, and specifically cover pieces 24 and 26, are configured to combust during or immediately after dome cover deployment to minimize or eliminate the production of dome cover debris. In preferred embodiments, combustive cover 14 undergoes a deflagration process (i.e., a rapid, subsonic combustion) upon ignition. It should be noted that deflagration is properly distinguished from detonation, which is characterized by supersonic combustion propagating through shock wave compression. Combustion of dome cover 14 reduces cover 14 to gaseous and particulate reaction byproducts, such as ash. Such reaction byproducts pose little to no risk of foreign object damage to nearby objects (e.g., the engine or rotor of a rotary wing aircraft) and are consequently referred to herein as "low-FOD reaction byproducts." Although it is generally preferred that dome cover 14 disintegrates substantially completely as a result of combustion, especially in embodiments wherein guided munition system 10 is deployed onboard an aircraft, this is not necessary in all embodiments; in certain embodiments, such as when guided munition system 10 is deployed onboard a ground-based vehicle, combustion of dome cover 14 may result in partial disintegration or break-up of cover 14 and may yield larger debris.

The body of combustive dome cover 14 may be formed as a single layer, homogenous structure. This notwithstanding, it is generally preferred that the body of combustive dome cover 14 is formed as a multi-layer structure, which includes a readily-ignitable inner combustive liner and at least one outer thermally insulative layer. For example, as shown in detail FIG. 1 at 54, the body of combustive dome cover 14 may be formed to include three layers: (i) an inner combustive liner 56; (ii) an outer inert layer or shell 58, which is formed over (e.g., deposited over) inner combustive liner 56; and (iii) an outer ablative coating 60, which is formed over (e.g., deposited over) outer inert layer 58. As utilized herein, the term "outer inert layer" is utilized in a relative sense to indicate denote a body of material having a combustive activation energy threshold that is lower than that of the inner combustive liner. By disposing an outer inert layer (e.g., layer 58), and possibly an outer ablative coating (e.g., coating 60), inner combustive liner 58 can be insulated from external heat sources (e.g., heated exhaust gases generated during launch of neighboring munitions) and the likelihood of premature ignition of the inner combustive liner can be minimized.

Inner combustive liner 56 may be formed from any material or materials that, when exposed to a predetermined ignition temperature (or otherwise has applied thereto sufficient total energy to surpass the ignition threshold), ignite and rapidly combust to initiate break-up of combustive dome cover 14 in an abbreviated time frame (e.g., on the order of a few fractions of a second). In a similar manner, outer inert layer 58 may likewise be formed from any material or materials that undergoes rapid combustion when exposed to the high temperatures generated during combustion of inner combustive liner 56. In many cases, outer inert layer 58 and inner combustive liner 56 may contain or be fabricated from similar base materials, but differ in composition. In a preferred embodiment, inner combustive liner 56 comprises a combustive fiber matrix that contains at least one highly flammable compound, such as nitrocellulose (also commonly referred to as "cellulose nitrate" or "guncotton"). Outer inert layer 58 may likewise comprise a combustive fiber matrix that is substantially free of the highly flammable compound or compounds (e.g., nitrocellulose) contained within liner 56 or that has a significantly lower concentration thereof. Stated differently, in a preferred embodiment, inner combustive liner 56 may comprise a relatively energetic nitrocellulose-containing material having a sufficient nitrogen group density to initiate and accelerate a rapid combustive process, while outer inert layer 58 may comprise a lower energy or non-energetic nitrocellulose-containing having the minimal nitrogen group density required to sustain combustion. Additional materials (e.g., resins) may be added to inner combustive liner 56 and outer inert layer 58, as appropriate, to optimize the rigidity and durability of combustive dome cover 14. The thickness and specific composition of inner combustive liner 56 and of outer inert layer 58 will vary amongst different embodiments in relation to the desired ignition temperature of inner combustive liner 56, to the desired thermal insulation provided by outer inert layer 58, and other such design parameters. Although shown in FIG. 1 as discrete structures, inner combustive layer 56 and outer inert layer 58 may be formed as a gradient structure in certain embodiments with concentration of the flammable agent or agents increasing with increasing proximity to the interior surface of combustive dome cover 14. In most cases, outer inert layer 58 will comprise a fairly rigid, thermally-insulative shell formed over inner combustive liner 56.

While embodiments combustive dome cover 14 may not include an outer ablative coating, the provision of an outer ablative coating, such as outer ablative coating 60, is useful for providing additional thermal insulation of inner combustive liner 56. Any one of a number of different conventionally-known, thermally-insulative ablative materials can be utilized as outer ablative coating 60, including various silicone-based coatings. Notably, the application and reapplication of outer ablative coating 60 can easily be performed by military personnel operating in-field utilizing, for example, an ablative kit. Thus, if significant material loss of the original ablative coating should occur due to, for example, repeated exposure to rocket exhaust gas during the launch of neighboring munitions, additional ablative material can be applied over outer inert layer 58 to restore outer ablative coating 60 to a desired thickness. Suitable silicone ablative kits are commercially available from the Dow Corning Corporation headquartered in Midland, Mich.

Guided munition system 10 further conveniently includes at least one heating feature thermally coupled to combustive dome cover 14 and, specifically, to inner combustive liner 56, which generates a sufficient heat quantity at the desired time of deployment to ignite liner 56 and, thus, initiate combustion of dome cover 14. In certain embodiments, the heating feature may assume the form of an aerodynamic heating structure, which projects from the body of dome cover 14 to generate heat during munition flight and auto-ignite dome cover 14. In such embodiments, the heating feature (or features) can be integrally formed with dome cover 14, and dome cover 14 may be formed a unitary or single-piece body. An example of a combustive dome cover including such an aerodynamic heating structure is described below in conjunction with FIG. 7. In other embodiments, the heating feature (or features) may assume the form of one or more ignition devices, such as relatively small explosive devices or heating elements, which are thermally coupled to, and possibly mounted to or embedded within, inner combustive liner 56. In this case, the ignition device (or devices) may be actuated pursuant to an ignition signal generated by a source either internal to or external to guided munition 12, as described more fully below in conjunction with FIGS. 5 and 6. Alternatively, the ignition device (or devices) may be actuated passively during munition flight; e.g., triggered, either directly or indirectly, by drag forces generated during flight of guided munition 12. Examples of such a drag-actuated ignition devices are described more fully below.

Referring once again to FIG. 1, guided munition system 10 further includes a pull-actuated ignition device 62 (e.g., a small friction-actuated explosive charge), which is mounted to the interior of cover piece 26; and an elongated connective member (e.g., a lanyard 64), which is connected between ignition device 62 and the interior of cover piece 24. As cover pieces 24 and 26 separate during munition flight, lanyard 64 exerts a pull force on ignition device 62, which causes device 62 to detonate and ignite inner combustive liner 56 of cover piece 24. At substantially the same time, a second ignition device (hidden from view in FIG. 1) may also be actuated in an identical manner to ignite inner combustive liner 56 of cover piece 26. Pursuant to ignition of inner combustive liner 56, combustive dome cover 14 undergoes a deflagration process during which the body of cover 14 is reduced to low- FOD reaction byproducts (e.g., gaseous and solid particulate reaction byproducts). Combustive dome cover 14 is thus effectively destroyed immediately after deployment to thereby reduce or entirely eliminate the risk of foreign object damage to nearby objects, including the vehicle or platform from which guided munition 12 is launched (e.g., a rotary wing aircraft equipped with a rocket pod or other multi-munition launch unit). Although the disposition of ignition device 62 will vary amongst embodiments, ignition device 62 is preferably positioned aft of seeker dome 20 and sufficiently offset from dome 20 in a longitudinal direction to ensure that detonation of device 62 does not contribute to contamination of dome 20. Ignition device 62 is also preferably positioned at a location whereat separation of cover pieces 24 and 26 is relatively pronounced; e.g., ignition device 62 may be positioned adjacent to or coupled between radial projections 44 and 46.

Figure 4:
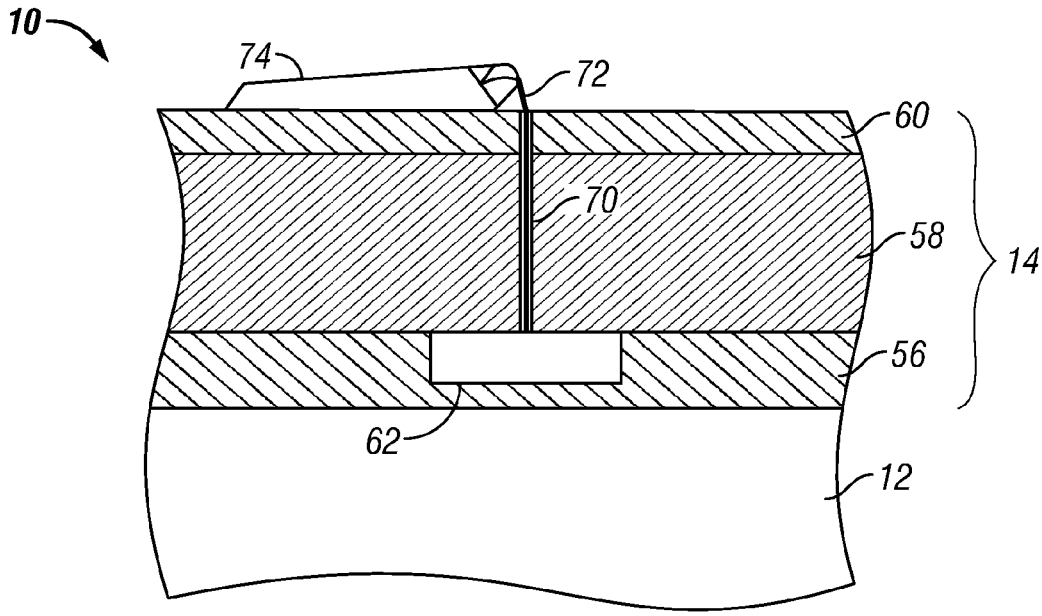
FIG. 4 is a cross-sectional view of a guided munition system including a combustive dome cover (partially shown) disposed over a guided munition (also partially shown) and including a drag-actuated ignition device in accordance with an additional exemplary embodiment.

The foregoing has thus provided an exemplary embodiment wherein guided munition system 10 employed an ignition device 64 actuated by the separation of multi-piece dome cover 14. In the above-described exemplary embodiment, separation of multi-piece dome cover 14 was driven primarily by drag forces acting on dome cover 14 and, specifically, on the blunt face of leading wall 36. In further embodiments, detonation of ignition device 64 may be passively triggered utilizing a drag-actuated ignition device (e.g., a relatively small pull-actuated explosive device), and separation of dome cover 14 may be augmented by or entirely driven by combustion of inner combustive liner 56 (FIG. 1). This may be more fully appreciated by referring to FIG. 4, which illustrates a variant of exemplary guided munition system 10 (guided munition 12 and combustive dome cover 14 partially shown). In this case, pull-actuated ignition device 62 is thermally coupled to, and specifically embedded within, inner combustive liner 56. A radial bore 70 extends from ignition device 62, through outer inert layer 58, through outer ablative coating 60 (if provided), and to the external surface of combustive dome cover 14. An elongated connective member (e.g., a lanyard 72) extends through radial bore 70 to couple pull-actuated ignition device 62 to a drag-generating member, namely, a drogue chute 74, which is positioned on the exterior of dome cover 14. When guided munition 12 surpasses a predetermined airspeed during flight, drogue chute 74 fills with fore-aft airflow and exerts a sufficient pull force on lanyard 72 to trigger the detonation of ignition device 62. The detonation of ignition device 62 results in the ignition of inner combustive liner 56, which results in the above-described combustion of dome cover 14.

Figure 5:
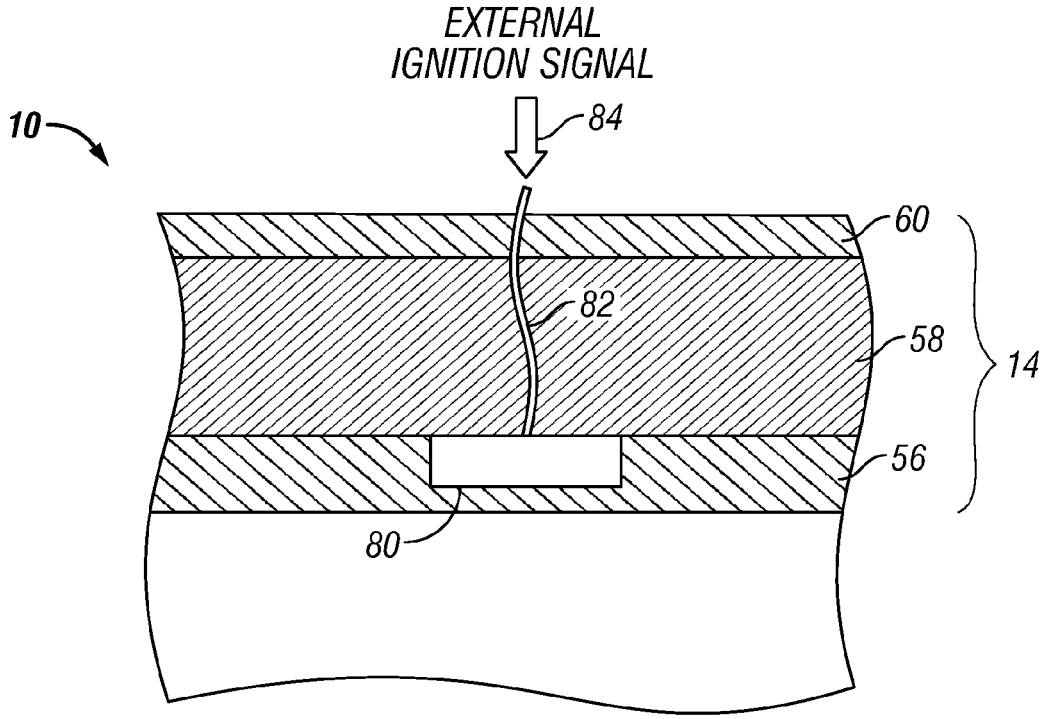
FIGS. 5 and 6 are cross-sectional views of guided munition systems including portions of combustive dome covers (partially shown) disposed over guided munitions (also partially shown) and including ignition devices actuated by externally- and internally-generated electrical signals, respectively, and illustrated in accordance with further exemplary embodiments.

In a preferred embodiment, radial bore 70 is covered or plugged to prevent the inflow of hot exhaust gases into bore 70 and to inner combustive liner 56. As illustrated in FIG. 5, this may be accomplished by forming radial bore 70 to have an inner diameter slightly larger than the outer diameter of lanyard 72 such that lanyard 72 substantially fills bore 70. Additionally or alternatively, radial bore 70 may be sealed with a plugging material and/or the outer mouth of radial bore 70 may be covered utilizing, for example, a strip of tape. In embodiments wherein the combustive dome cover includes multiple pieces and an ignition device that is not triggered by the separation of the dome cover pieces, separation of the dome cover pieces may be primarily or entirely effectuated by combustion of an inner combustive layer. Thus, in such embodiments, the dome cover need not be provided with a blunt forward wall, inner radial projections, or other such features directed to the aerodynamically-driven separation of the dome cover pieces. Notably, usage of a drogue chute or a similar drag-generating member allows drag to be minimized until the desired deployment speed, at which time a rapid drag impulse is generated. Such a rapid drag impulse has a negligible effect on munition range and autopilot stability, especially if occurring during munition launch or an early phase of munition flight.

The foregoing has thus described multiple exemplary embodiments of a guided munition system including a combustive dome cover that rapidly combusts pursuant to dome cover deployment to minimize the production of debris. In the above-described exemplary embodiments, deployment of the combustive dome cover occurred during munition flight and was passively initiated without the usage of timing electronics or other electronic control devices. Advantageously, inflight deployment of the combustive dome cover allows the dome cover to remain in place over the seeker dome, and thus shield the seeker dome from contamination, through launch and an initial stage of munition flight. This advantage notwithstanding, in certain instances, it may be desired to actively initiate the deployment and the corresponding combustion of the dome cover immediately prior to munition launch. In particular, by deploying the combustive dome cover prior to munition launch, the munition seeker can perform prelaunch target acquisition and verification (commonly referred to as "lock-on before launch"). In such embodiments, a signal-actuated ignition device (e.g., a squib) may be embedded within the combustive dome cover and triggered by an ignition signal generated by a source external to the guided munition system, such as by an aircraft carrying the guided munition (described more fully below in conjunction with FIG. 5). Alternatively, an ignition device (e.g., a squib) may be embedded within the combustive dome cover and triggered by an ignition signal generated by an electronic device (e.g., the control guidance unit) deployed onboard the guided munition, as described below in conjunction with FIG. 6.

FIG. 5 is a cross-sectional view of a variant of exemplary guided munition system 10 wherein the ignition of combustive dome cover 14 (and, specifically, of inner combustive liner 56) is controlled by a signal-actuated ignition device, namely, a squib 80. As appearing herein, the term "squib" is utilized to denote any electrically-actuated pyrotechnic device capable of producing a sufficient quantity of heat to ignite the dome cover's inner combustive layer. As can be seen in FIG. 5, a wire 82 is operably coupled to squib 90 and extends through outer inert layer 58 and outer ablative coating 60 to the exterior of combustive dome cover 14. The outer terminal end of wire 82 (not shown in FIG. 5) is, in turn, operably coupled to an external controller; e.g., if deployed onboard an aircraft, a connector may be provided on the terminal end of wire 82, which may be plugged into a mating connector electrically coupled to an avionic control system. Immediately prior to launch of guided munition 12 (e.g., in response to pilot commands), the external controller transmits an ignition signal to squib 82 (represented in FIG. 5 by arrow 84) to detonate squib 82 and thereby ignite inner combustive liner 56. Inner combustive liner 92 and, more generally, combustive dome cover 14 then undergo rapid combustion, preferably a deflagration process, and are effectively reduced gaseous and solid particulate reaction byproducts. A substantial portion of the combustion of combustive dome cover 14 may occur while dome cover 12 remains positioned over guided munition 12; however, in embodiments wherein combustive dome cover 14 is formed from multiple separable pieces, rapid combustion of liner 56 preferably generates sufficient pressures along the interior surfaces of combustive dome cover 14 to cause cover 14 to separate or fragment into multiple individual cover pieces, which are then displaced from (e.g., drop away from) guided munition 12 as combustion of dome cover 14 continues. Advantageously, prelaunch deployment of combustive dome cover 14 enables guided munition 12 to provide lock-on-before-launch functionalities, as previously described.

Figure 6:
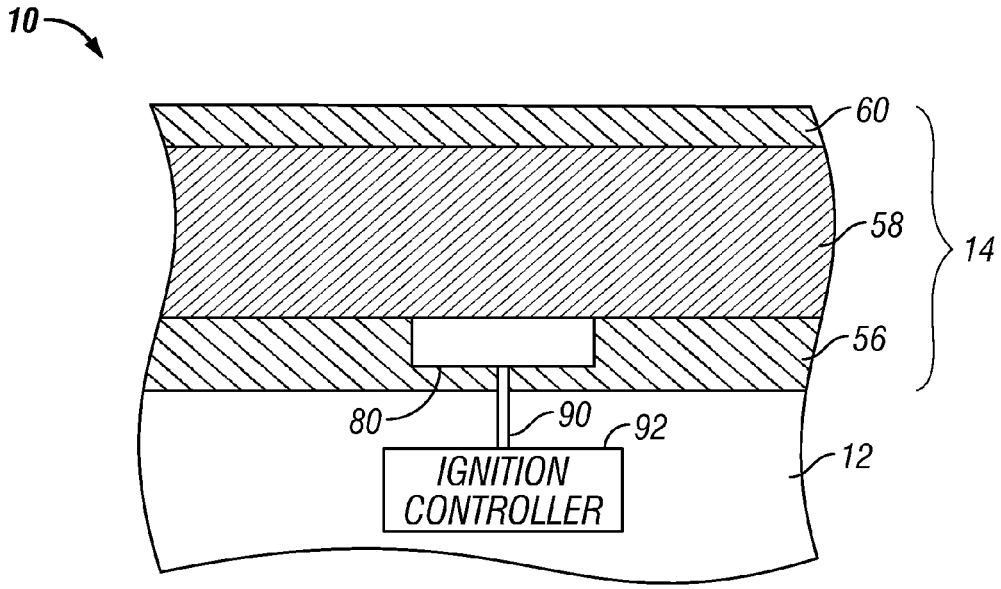

Although in the foregoing example, the ignition signal initiating the detonation of squib 80 was generated by a source external to guided munition system 10, this need not always be the case. As indicated in FIG. 6, which is a cross-sectional view of yet another variant of exemplary guided munition system 10, squib 80 may be operably coupled via a wire 90 to a control device (generically referred to herein as an "onboard ignition controller 92") carried by guided munition 12. During operation, onboard ignition controller 92 may transmit an ignition signal to squib 80 to detonate squib 80, and therefore initiate combustion of combustive dome cover 14, at a desired time of deployment. For example, ignition system 92 may provide an ignition signal to squib 80 upon prelaunch activation of guided munition 12. Ignition controller 92 may comprise any electronic device or electronic devices carried by guided munition 12 suitable for performing this function, such as the seeker electronics or a mission computer.

Figure 7:
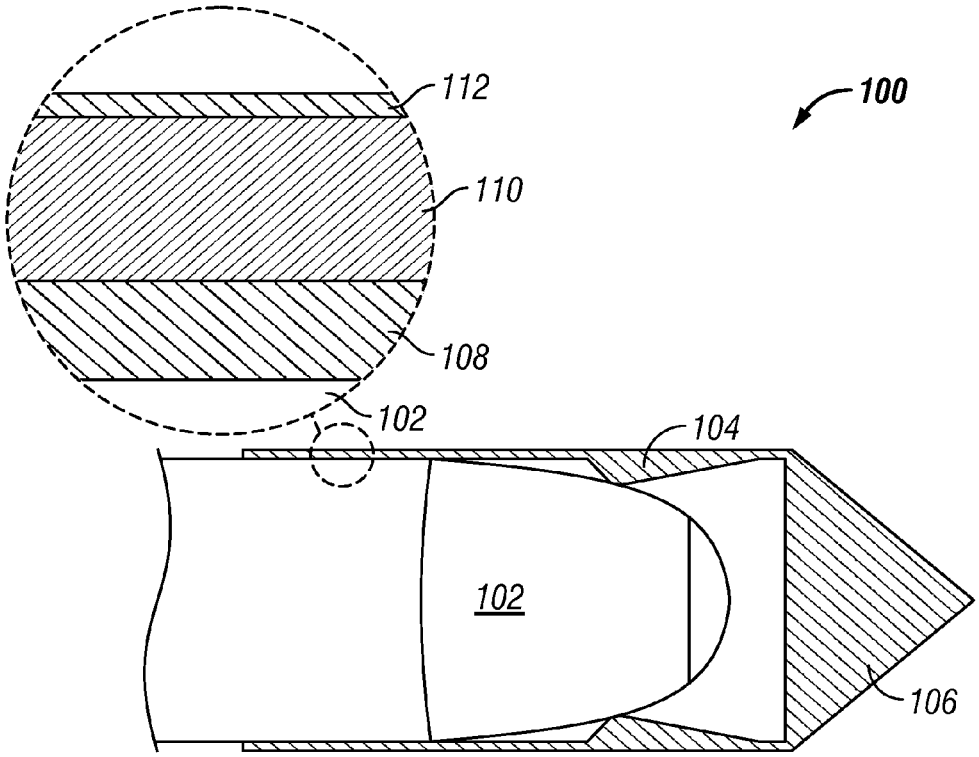
FIG. 7 is a cross-sectional view of a guided munition system including a single-piece combustive dome cover disposed over a guided munition (partially shown) and configured to auto-ignite in response to aerodynamic heating during munition flight and illustrated in accordance with a still further exemplary embodiment.

As previously noted, in still further embodiments, combustive dome cover may include one or more aerodynamic heating structures, which provide localized heating the combustive dome cover during munition flight to bring about auto-ignition of the combustive dome cover at a desired airspeed. Further emphasizing this point, FIG. 7 is an isometric view of a guided munition system 100 including a guided munition 102 (partially shown), a combustive dome cover 104 (shown in cross-section), and an aerodynamic heating structure 106 in accordance with a further exemplary embodiment. As was the case previously, combustive dome cover 104 may be fabricated to include an inner combustive liner 108, an outer inert layer 110, and, if desired, an outer ablative coating 112. In this particular example, aerodynamic heating structure 106 assumes the form of a conical body or nose, which projects outward from the body of dome cover 104 in a forward direction. As indicated in FIG. 7, aerodynamic heating structure 106 and dome cover 104 is preferably integrally formed as a single piece or unitary body 104, 106 to increase ruggedness and overall resistance to damage during, for example, soldier handling; however, the possibility that structure 106 and/or dome cover 104 is assembled or constructed from multiple components is by no means excluded. During munition flight, high velocity airflow heats the terminal end or tip of structure 106 in a localized manner. As the tip of structure 106 continues to heat, heat is conductively transferred through outer inert layer 110 (and through any portion of ablative coating 112 that has not eroded away) and gradually heats inner combustive liner 108 (often referred to as "heat soak"). When surpassing its predetermined ignition temperature, inner combustive liner 108 ignites; and liner 108, and more generally combustive dome cover 104, then rapidly combust to expose the underlying seeker dome and reduce cover 104 to low-FOD reaction byproducts. In a preferred embodiment, the compositional (e.g., nitrogen concentration and structural characteristics of structure 106 are selected to initiate combustion of dome cover 104 when guided munition 102 surpasses a predetermined conflagration speed. In further embodiments, the aerodynamic heating structure or structures may assume various other forms, such as protruding structures (e.g., pitot tube-like extensions) having sharp edges or corners that extend radially outward from the body of dome cover 104 and through the aerodynamic boundary layer formed during high velocity (e.g., supersonic) flight of guided munition 102.

The foregoing has thus provided multiple exemplary embodiments of a guided munition system including a combustive dome cover is configured to uncover a seeker dome at a predetermined time of deployment and to combust to minimize the production of debris when so deployed to reduce the likelihood of foreign object damage. In some of the above-described exemplary embodiments, the combustive dome cover self-deploys during munition flight (e.g., in response to drag forces acting on a drag-generating member or initiating separation of a multi-piece cover) at a predetermined airspeed without the aid of timing electronics or other control devices. Furthermore, in at least some of the above-described exemplary embodiment, the combustive dome cover is able to be deployed immediately prior to munition launch (e.g., via transmission of an ignition signal to a signal-actuated squib) to enable prelaunch target verification by the munition's seeker (referred to as "lock-on before launch"). In a more general sense, the foregoing has also provided a method for equipping a guided munition with a combustive dome cover. In one embodiment, the method includes the steps of fabricating a combustive dome cover configured to combust when exposed to a predetermined ignition temperature, coupling a heating feature to the combustive dome cover, and positioning the combustive dome cover over a seeker dome included within the guided munition.

While the foregoing has specifically described embodiments of a guided munition system including an ignition device that generates heat to ignite the inner combustive liner of a combustive dome cover, it will be appreciated that the ignition device may assume any form suitable for igniting the combustive dome cover by applying sufficient total reaction energy thereto, whether or not the ignition device generates heat directly, and including various types of chemical and electrical ignition devices. For example, in certain embodiments, the ignition device may expose the inner combustive liner to a chemical agent (e.g., an accelerant or acid) at a desired juncture by, for example, rupture of a vile containing the chemical agent to ignite the combustive dome cover; e.g., such a vile could be ruptured by the separation of a multi-part dome cover, such as dome cover 14 described above in conjunction with FIGS. 1-3. Alternatively, the ignition device may heat the combustive liner in an indirect manner by, for example, generating electromagnetic energy (e.g., microwaves), which heats embedded metal or alloy filaments or other bodies embedded within the combustive dome cover to provided the requisite activation energy to initiate the combustion reaction.

While at least one exemplary embodiment has been presented in the foregoing Detailed Description, it should be appreciated that a vast number of variations exist. It should also be appreciated that the exemplary embodiment or exemplary embodiments are only examples, and are not intended to limit the scope, applicability, or configuration of the invention in any way. Rather, the foregoing Detailed Description will provide those skilled in the art with a convenient road map for implementing an exemplary embodiment of the invention. It being understood that various changes may be made in the function and arrangement of elements described in an exemplary embodiment without departing from the scope of the invention as set-forth in the appended Claims.

What is claimed is:

1. A guided munition system, comprising:

a guided munition, comprising:

a munition body; and a seeker including one or more electromagnetic radiation sensors; and a seeker dome through which electromagnetic signals are received and passed to the seeker, said seeker dome coupled to the munition body; and a combustive dome cover disposed over the seeker dome to physically shield the seeker dome from potential sources of contamination, the combustive dome cover configured to uncover the seeker dome at a predetermined time of deployment prior to seeker operation and to combust when so deployed to minimize the production of debris.

2. A guided munition system according to claim 1 wherein the heating feature comprises an aerodynamic heating structure projecting from the combustive dome cover and configured to generate heat during munition flight to auto-ignite the combustive dome cover.

3. A guided munition system according to claim 2 wherein the aerodynamic heating feature comprises a substantially conically-shaped nose portion extending from the combustive dome cover.

4. A guided munition system according to claim 2 wherein the aerodynamic heating structure is integrally formed with the combustive dome cover.

5. The guided munition system according to claim 1 further comprising a heating feature thermally coupled to the combustive dome cover to generate a sufficient heat quantity at the predetermined time of deployment to initiate combustion of the dome cover to minimize the production of debris.

6. A guided munition system comprising:

a guided munition, comprising:

a munition body; and a seeker dome coupled to the munition body;

a combustive dome cover disposed over the seeker dome; and a heating feature thermally coupled to the combustive dome cover, the combustive dome cover configured to uncover the seeker dome at a predetermined time of deployment and to combust when so deployed to minimize the production of debris.

7. A guided munition system, comprising:

a guided munition, comprising:

a munition body; and a seeker dome con led to the munition body;

a combustive dome cover disposed over the seeker dome; and an ignition device coupled to the combustive dome cover, the combustive dome cover configured to uncover the seeker dome at a predetermined time of deployment and to combust when so deployed to minimize the production of debris.

8. A guided munition system according to claim 7 wherein the combustive dome cover comprises:

a first cover piece; and a second cover piece coupled to the first cover piece to enclose the seeker dome.

9. A guided munition system according to claim 8 wherein the first and second cover pieces are configured to separate during munition flight, and wherein the ignition device is actuated by separation of the first and second cover pieces.

10. A guided munition system according to claim 9 wherein the ignition device is mounted to the first cover piece, and wherein the guided munition system further comprises an elongated connective member coupling the ignition device to the second cover piece.

11. A guided munition system according to claim 7 further comprising a drag-generating member coupled to the ignition device and configured to actuate the ignition device at a predetermined airspeed during munition flight.

12. A guided munition system according to claim 7 wherein the ignition device is at least partially embedded in the combustive dome cover.

13. A guided munition system according to claim 7 wherein the ignition device comprises a signal-actuated squib.

14. A guided munition system according to claim 13 further comprising an electrical conductor operably coupled to the signal-actuated squib and accessible from the exterior of the combustive dome cover to enable actuation of the signal-actuated squib by an externally-generated ignition signal.

15. A guided munition system according to claim 13 wherein the guided munition further comprises an ignition controller disposed within the munition body and operably coupled to the signal-actuated squib, the ignition controller configured to actuate the signal-actuated squib at a desired time of deployment.

16. A guided munition system, comprising:

a guided munition, comprising:

a munition body; and a seeker dome coupled to the munition body; and a combustive dome cover disposed over the seeker dome, the combustive dome cover comprising an inner combustive liner and an outer inert layer disposed over the inner combustive liner, the combustive dome cover configured to uncover the seeker dome at a predetermined time of deployment and to combust when so deployed to minimize the production of debris.

17. A guided munition system according to claim 16 wherein the inner combustive liner comprises nitrocellulose.

18. A guided munition system according to claim 16 further comprising an outer ablative coating formed over the outer inert layer.

19. A combustive dome cover, comprising:

an inner combustive liner configured to ignite when exposed to a predetermined ignition temperature; and an outer inert layer disposed over the inner combustive liner and configured to combust in conjunction with the inner combustive liner after ignition thereof.

20. A combustive dome cover according to claim 19 wherein the combustive dome cover is configured to be utilized in conjunction with a guided munition including a seeker dome, and wherein outer inert layer comprises a substantially rigid shell disposed over the seeker dome to shield the seeker dome from exposure to external contaminants.

21. A method for equipping a guided munition with a combustive dome cover, the method comprising the steps of:

fabricating a combustive dome cover configured to combust when exposed to a predetermined ignition temperature;

coupling a heating feature to the combustive dome cover; and positioning the combustive dome cover over a seeker dome included within the guided munition.

22. The method according to claim 21 wherein the heating feature comprises an ignition device.

23. The method according to claim 21 wherein the heating feature comprises an aerodynamic heating structure projecting from the combustive dome cover and configured to generate heat during munition flight to auto-ignite the combustive dome cover.

24. A guided munition system, comprising:

a guided munition, comprising:

a munition body; and a seeker dome coupled to the munition body;

a combustive dome cover disposed over the seeker dome, the combustive dome cover configured to uncover the seeker dome at a predetermined time of deployment; and a heating feature thermally coupled to the combustive dome cover to generate a sufficient heat quantity at the predetermined time of deployment to initiate combustion of the dome cover to minimize the production of debris.

25. The guided munition system according to claim 24, wherein the heating feature comprises an ignition device.

26. The guided munition system according to claim 24, wherein the heating feature comprises an aerodynamic heating structure projecting from the combustive dome cover and configured to generate heat during munition flight to auto-ignite the combustive dome cover.

* * * * *

UNITED STATES PATENT AND TRADEMARK OFFICE

CERTIFICATE OF CORRECTION

PATENT NO. : 8,445,823 B2
APPLICATION NO. : 12/917705
DATED : May 21, 2013
INVENTOR(S) : Darin S. Williams It is certified that error appears in the above-identified patent and that said Letters Patent is hereby corrected as shown below:

In the Claims

In column 13, claim 7, line 46, delete ""con led" and insert --coupled--.

Signed and Sealed this
Second Day of July, 2013

Teresa Stanek Rea
*Acting Director of the United States Patent and Trademark Office*